US010662752B2

(12) United States Patent
Shanmugam et al.

(10) Patent No.: US 10,662,752 B2
(45) Date of Patent: May 26, 2020

(54) SYSTEM AND METHOD FOR REMOTE MONITORING OF DRILLING EQUIPMENT

(71) Applicant: Harnischfeger Technologies, Inc., Wilmington, DE (US)

(72) Inventors: Saravana Manickam Malayappalayam Shanmugam, Oak Creek, WI (US); Michael J. Rikkola, New Berlin, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 45 days.

(21) Appl. No.: 15/485,461

(22) Filed: Apr. 12, 2017

(65) Prior Publication Data

US 2017/0218746 A1 Aug. 3, 2017

Related U.S. Application Data

(63) Continuation of application No. 13/754,082, filed on Jan. 30, 2013, now Pat. No. 9,657,567.

(Continued)

(51) Int. Cl.
*E21B 44/00* (2006.01)
*E21F 17/18* (2006.01)

(Continued)

(52) U.S. Cl.
CPC ..... *E21B 44/00* (2013.01); *E02F 3/30* (2013.01); *E02F 3/46* (2013.01); *E02F 9/264* (2013.01);

(Continued)

(58) Field of Classification Search
CPC ..... E21B 44/00; E21F 17/18; E02F 9/264; E02F 9/267
See application file for complete search history.

(56) References Cited

U.S. PATENT DOCUMENTS 5,659,470 A 8/1997 Goska et al.
5,844,800 A 12/1998 Brandt et al.

(Continued)

FOREIGN PATENT DOCUMENTS

CN 1677287 10/2005
EP 1273723 1/2003

(Continued)

OTHER PUBLICATIONS

Office Action issued by the Chilean Patent Office for related Application No. 2016-000996 dated Dec. 20, 2017 9 ( 8 pages including Statement of Relevance).

(Continued)

*Primary Examiner* — Donald J Wallace
(74) *Attorney, Agent, or Firm* — Michael Best & Friedrich LLP

(57) ABSTRACT

A system and method for capturing information related to mining machine performance and making the information accessible to remote maintenance staff. The information can be used to generate alarms, determine a state of the machine, determine performance statistics for the machine, and identify problems with the machine that may require attention. The information can be provided in a state message and the data can be packaged as XML data or in a string format. The data associated with a message can be particular to the current state or context of the mining machine. That is, in the case of a rope shovel, different data may be included in a message generated in a swing state versus a message generated in a tuck state. In some instances, a message is generated when progress thresholds are satisfied, such as for each foot of drilling performed by a mining drill.

20 Claims, 9 Drawing Sheets

Related U.S. Application Data

(60) Provisional application No. 61/632,767, filed on Jan. 30, 2012.

(51) Int. Cl.

| | |
|---|---|
| ***E21C 47/00*** | (2006.01) |
| ***G07C 5/00*** | (2006.01) |
| ***E02F 9/26*** | (2006.01) |
| ***E02F 3/30*** | (2006.01) |
| ***E02F 3/46*** | (2006.01) |

(52) U.S. Cl.

CPC ..... *E02F 9/267* (2013.01); *E21C 47/00* (2013.01); *E21F 17/18* (2013.01); *G07C 5/008* (2013.01)

(56) References Cited

U.S. PATENT DOCUMENTS

| | | | | |
|---|---|---|---|---|
| 7,143,007 | B2 | 11/2006 | Long et al. | |
| 7,246,156 | B2 | 7/2007 | Ginter et al. | |
| 7,324,923 | B2 | 1/2008 | DellaVilla et al. | |
| 7,406,399 | B2 | 7/2008 | Furem et al. | |
| 7,599,939 | B2 | 10/2009 | DeStefano et al. | |
| 7,693,633 | B2 | 4/2010 | Donnelli et al. | |
| 8,294,568 | B2 | 10/2012 | Barrett | |
| 8,838,417 | B2 | 9/2014 | Rikkola et al. | |
| 2002/0124652 | A1 | 9/2002 | Schultz et al. | |
| 2003/0055666 | A1 | 3/2003 | Roddy et al. | |
| 2003/0084053 | A1 | 5/2003 | Govrin et al. | |
| 2005/0085973 | A1 | 4/2005 | Furem et al. | |
| 2005/0144936 | A1 | 7/2005 | Hulse et al. | |
| 2006/0271582 | A1 | 11/2006 | Collins | |
| 2007/0192063 | A1* | 8/2007 | Abu-El-Zeet ..... | G05B 17/02 702/182 |
| 2008/0059005 | A1 | 3/2008 | Greiner et al. | |
| 2008/0059411 | A1 | 3/2008 | Greiner et al. | |
| 2008/0195365 | A1 | 8/2008 | Ohkura et al. | |
| 2008/0262820 | A1 | 10/2008 | Nasle | |
| 2009/0096637 | A1 | 4/2009 | Olson et al. | |
| 2009/0182472 | A1 | 7/2009 | Singh et al. | |
| 2009/0240481 | A1 | 9/2009 | Durrant-Whyte et al. | |
| 2011/0106384 | A1 | 5/2011 | Corke | |
| 2011/0108324 | A1 | 5/2011 | Stacy, II et al. | |
| 2011/0208567 | A9 | 8/2011 | Roddy et al. | |
| 2011/0282626 | A1 | 11/2011 | Rikkola et al. | |
| 2011/0282630 | A1 | 11/2011 | Rikkola et al. | |
| 2012/0092180 | A1 | 4/2012 | Rikkola et al. | |
| 2013/0190966 | A1 | 7/2013 | Collins et al. | |
| 2013/0197737 | A1 | 8/2013 | Malayappalayam Shanmugam et al. | |
| 2016/0356144 | A1* | 12/2016 | Toti ..... | G05B 13/04 |

FOREIGN PATENT DOCUMENTS

| | | |
|---|---|---|
| WO | WO1996016383 | 5/1996 |
| WO | WO2009152561 | 12/2009 |
| WO | WO2011143458 | 11/2011 |

OTHER PUBLICATIONS

Office Action from the Chilean Intellectual Property Office for Application No. 201300281, first known to us dated Sep. 9, 2015, (10 pages, which includes English Statement of Relevance).

Office Action from the Chilean Intellectual Property Office for Application No. 2013-000281, first known to us dated Mar. 6, J017, (2 pages, which includes English Statement of Relevance).

First Office Action from the Statement Intellectual Property Office of the People's Republic of China for Application No. 201310079979.1 dated May 25, 2016 (24 pages, English translation included).

Second Office Action from the Statement Intellectual Property Office of the People's Republic of China for Application No. 201310079979.1 dated Jan. 25, 2017 (25 pages, English translation included ).

First Office Action from the Australian Intellectual Property Office for Application No. 2015202551 dated Oct. 15, 2015, (3 pages).

Second Office Action from the Chilean Intellectual Property Office for Application No. 201300281, first known to us dated Oct. 27, 2015, (9 pages, which includes English Statement of Relevance).

First Office Examination from the Australian Intellectual Property Office for Application No. 2013200491 dated May 16, 2014 (7 pages).

"The Apache Cassandra Project," The Apache Software Foundation, 2009, retrieved from Internet <URL: cassandra. apache.org>.

"VMware vFabricTM GemFire," VMware, Inc., 2013, retrieved from Internet <URL: http://www.vmware.com/products/ application-platform/vfabric-gemfire/overview.html>.

"Apache Hadoop," The Apache Software Foundation, 2012, retrieved from Internet <URL: hadoop.apache.org>.

Feinleib, D., "The Big Data Landscape—About," BigDataLandscape. com, 2012, 14 pages.

Feinleib, D., "The Big Data Landscape—Apps, Infrastructure, Technologies," BigDataLandscape.com, Jan. 2013, 1 page.

Office Action dated Sep. 11, 2017 by the Chilean Patent Office for related Application No. 2016-000996 (8 pages, Statement of Relevance included).

Third Office Action from the Statement Intellectual Property Office of the People's Republic of China for Application No. 201310079979.1 dated Jul. 24, 2017 (6 pages, English Translation Included).

Office Action from the Canadian Patent Office for related Application No. 2804075 dated Oct. 30, 2018 (4 Pages).

Canadian Intellectual Property Office action for Application No. 2804075 dated Jun. 7, 2019 (4 pages).

Chilean Patent Office Action for Application No. 2016000996 dated Oct. 7, 2019 (3 pages including statement of relevance).

* cited by examiner

SYSTEM AND METHOD FOR REMOTE MONITORING OF DRILLING EQUIPMENT

RELATED APPLICATIONS

The present application claims priority to U.S. patent application Ser. No. 13/754,082, filed Jan. 30, 2013, which claims priority to U.S. Provisional Application No. 61/632,767, filed Jan. 30, 2012, the entire contents of which is hereby incorporated by reference.

BACKGROUND

Embodiments of the present invention generally relate to equipment monitoring, and specifically, to remotely monitoring heavy duty machinery.

SUMMARY

Industrial machinery, such as drilling equipment, requires maintenance to maintain machine uptime. As machines increase in size, complexity, and cost, failure to maintain the machine results in greater impact to production and cost. Information on why a machine failed is often not captured, thereby making it difficult to identify and troubleshoot any problems that led to the failure. Furthermore, even if the information is captured, it is usually stored onboard the machine, which requires that the information be accessed and pulled from the machine. These issues hinder root cause analysis and condition-based maintenance initiatives and make remote maintenance monitoring difficult or impossible.

Therefore, embodiments of invention provide systems and methods for capturing information related to machine performance and making the information accessible to remote maintenance staff. The information can be used to generate alarms, determine a state of the machine, determine performance statistics for the machine, and identify problems with the machine that may require attention (e.g., identifying when a particular part of the machine should be replaced). The information can be presented to remote maintenance staff on a computer-generated dashboard and can be presented in various forms, including graphical displays, color-coded displays, summary report, trends, graphs, charts, lists, waveforms, etc.

The systems and methods provide a better way to obtain details of the machinery state and cycles. The information can be provided in a state message and the data can be packaged as XML data or in a string format. These messages can be structured according to industry standards that abide by Object Linking and Embedding (OLE) for Process Control (OPC) Specifications and can be used by many external production monitoring systems.

In some embodiments, the invention provides a method of monitoring a mining machine. The method includes determining that the mining machine is operating in a first operation state of a plurality of defined operation states of the mining machine and detecting a transition of the mining machine from the first operation state to a second operation state of the plurality of defined operation states. The method includes monitoring mining machine parameters of the mining machine. The method further includes generating a state exit message indicating an end of the first operation state and generating a state start message indicating a start of the second operation state. The state exit message includes a first set of the mining machine parameters associated with the first operation state, while the state start message includes a second set of the mining machine parameters associated with the second operation state.

In some embodiments, the invention provides a mining machine monitor for monitoring a mining machine. The mining machine monitor includes a monitoring module that monitors mining machine parameters of the mining machine. The mining machine monitor further includes a state machine module and a message generating module. The state machine module determines that the mining machine is operating in a first operation state of a plurality of defined operation states of the mining machine, and detects a transition of the mining machine from the first operation state to a second operation state of the plurality of defined operation states. The message generating module generates a state exit message indicating an end of the first operation state and generates a state start message indicating a start of the second operation state. The state exit message includes a first set of the mining machine parameters associated with the first operation state, while the state start message includes a second set of the mining machine parameters associated with the second operation state.

In some embodiments, the invention provides a method of monitoring a mining drill. The method includes drilling a hole with the mining drill and monitoring mining machine parameters of the mining drill. The method further includes determining when the mining drill reaches a plurality of progress thresholds while drilling the hole, each progress threshold representing a depth of the hole. In response, the method includes generating a drill context message each time the mining drill is determined to reach one of the progress thresholds. The drill context message including a first set of the mining machine parameters associated with the mining drill.

In some instances, the method further includes determining that the mining drill has completed drilling the hole; and generating a hole end message indicating that the hole has been drilled. The hole end message includes a second set of the mining machine parameters different than the first set of the mining machine parameters. In some instances, the method further includes determining that the mining drill is operating in a new operation state; and generating a state start message indicating a start of the new operation state. The state start message includes third set of the mining machine parameters associated with the new operation state.

In some embodiments, the invention provides a mining machine monitor for monitoring a mining drill. The mining machine monitor includes a monitoring module that monitors mining machine parameters of the mining drill; a state machine module that determines that the mining drill is operating in a drill state; and a message generating module. The message generating module monitors progress of the mining drill in drilling the hole; determines when the mining drill reaches a plurality of progress thresholds while drilling the hole, each progress threshold representing a depth of the hole; and generates a drill context message each time the mining drill is determined to reach one of the progress thresholds, the drill context message including a first set of the mining machine parameters associated with the mining drill.

In some instances, the state machine module further determines that the mining drill has completed drilling the hole; and the message generating module further generates a hole end message indicating that the hole has been drilled. The hole end message includes a second set of the mining machine parameters different than the first set of the mining machine parameters. In some instances, the state machine module determines that the mining drill is operating in a new operation state; and the message generating module generates a state start message indicating a start of the new operation state. The state start message includes a third set of the mining machine parameters associated with the new operation state.

In some embodiments, the invention provides a method of monitoring a mining machine. The method includes monitoring mining machine parameters of the mining machine and the operation state of the mining machine. The method further includes determining that the mining machine is operating in a first operation state of a plurality of defined operation states of the mining machine. The method further includes generating a first state message indicating the first operation state and including a first set of the mining machine parameters associated with the first operation state. The method further includes determining that the mining machine is operating in a second operation state of the plurality of defined operation states and generating a second state message indicating a the second operation state including a second set of the mining machine parameters associated with the second operation state.

In some instances, the method further includes detecting a state transition from the first operation state to the second operation state and, in response, generating a third state message indicting the second operation state and including a third set of mining machine parameters associated with the transition.

In some embodiments, the invention provides a mining machine monitor for monitoring a mining machine. The mining machine monitor includes a monitoring module that monitors mining machine parameters of the mining machine. The mining machine monitor further includes a state machine module that determines the operating state of the mining machine and a message generating module that generates and outputs messages with state-specific parameters. The state machine module determines that the mining machine is operating in a first operation state of a plurality of defined operation states of the mining machine. Accordingly, the message generating module generates a first state message indicating the first operation state and including a first set of the mining machine parameters associated with the first operation state. The state machine later determines that the mining machine is operating in a second operation state of the plurality of defined operation states. Accordingly, the message generating module generates a second state message indicating a the second operation state including a second set of the mining machine parameters associated with the second operation state.

In some instances, the state machine module further includes detecting a state transition from the first operation state to the second operation state. In response, the message generating module generates a third state message indicting the second operation state and including a third set of mining machine parameters associated with the transition.

DETAILED DESCRIPTION

Figure 1A:
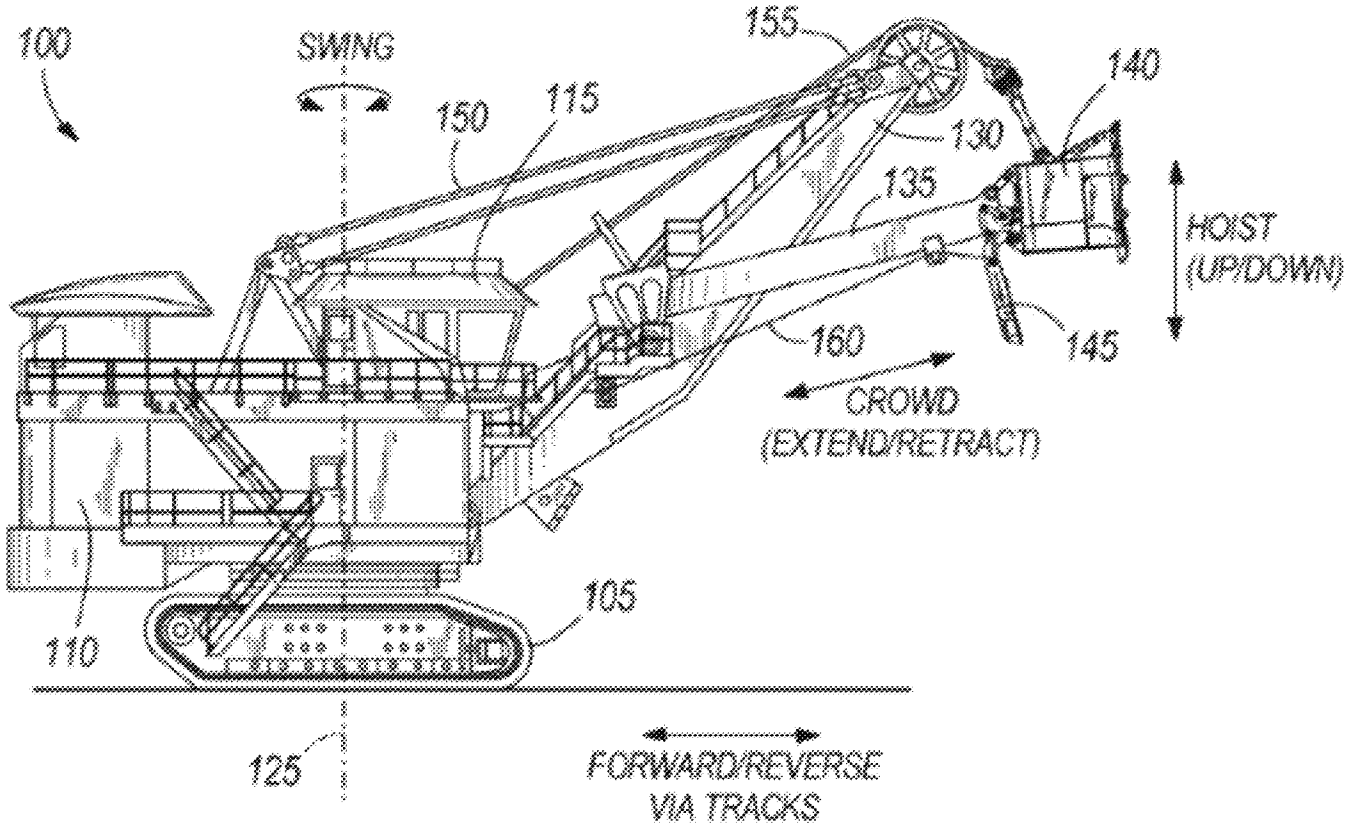
FIG. 1A illustrates a mining shovel.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1A illustrates an electric mining rope shovel 100, herein referred to as shovel 100. The shovel 100 includes tracks 105 for propelling the shovel 100 forward and backward, and for turning the shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. Movement of the tracks 105 is not necessary for the swing motion. The shovel 100 further includes a dipper shaft 130 supporting a pivotable dipper handle 135 (handle 135) and dipper 140. The dipper 140 includes a door 145 for dumping contents from within the dipper 140 into a dump location, such as a hopper or dump-truck.

The shovel 100 also includes taut suspension cables 150 coupled between the base 110 and dipper shaft 130 for supporting the dipper shaft 130; a hoist cable 155 attached to a winch (not shown) within the base 110 for winding the cable 155 to raise and lower the dipper 140; and a dipper door cable 160 attached to another winch (not shown) for opening the door 145 of the dipper 140. In some instances, the shovel 100 is a P&H® 4100 series shovel produced by P&H Mining Equipment Inc., although the shovel 100 can be another type or model of electric mining equipment.

When the tracks 105 of the mining shovel 100 are static, the dipper 140 is operable to move based on three control actions, hoist, crowd, and swing. The hoist control raises and lowers the dipper 140 by winding and unwinding hoist cable 155. The crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control swivels the handle 135 relative to the swing axis 125. During operation, an operator controls the dipper 140 to dig earthen material from a dig location, swing the dipper 140 to a dump location, release the door 145 to dump the earthen material, and tuck the dipper 140 to cause the door 145 to close, and swing to the same or another dig location.

The shovel 100 further includes an AC power supply (not shown) for driving various motors and components. The AC power supply may be transformed, rectified, inverted, filtered, and otherwise conditioned to power various AC and DC motors and components of the shovel 100. For instance, the shovel 100 may use the AC power supply to drive motors for propelling the shovel 100 via tracks 105 and for driving the hoist, crowd, and swing motors. Additionally, the shovel 100 may further include an internal combustion engine, such as a diesel engine, to drive hydraulic pumps for various hydraulic systems of the shovel 100.

Figure 1B:
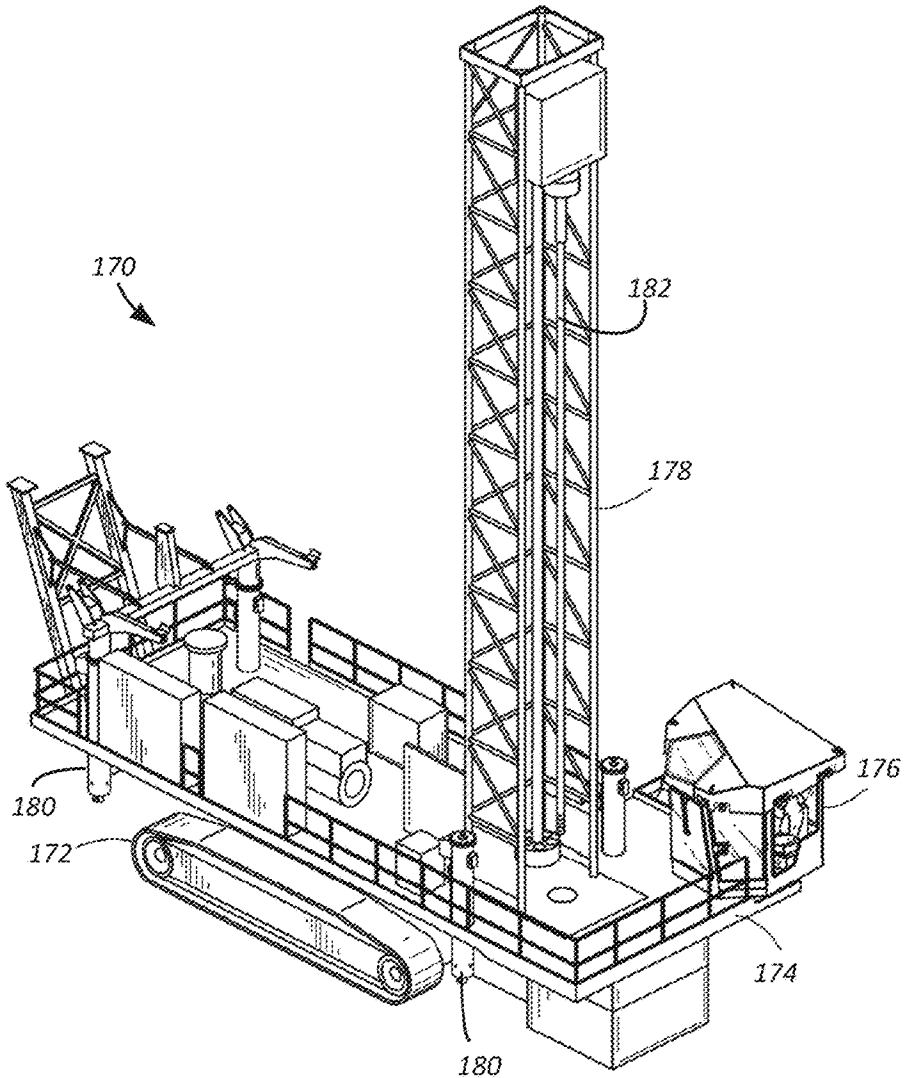
FIG. 1B illustrates a mining drill.

FIG. 1B illustrates an electric mining drill 170 (the "drill 170"). In some embodiments, the drill 170 is a blast hole drill, such as a 320 XPC drill or another Centurion®-based drill manufactured by Job Global, Inc.

The drill 170 includes tracks 172 for propelling the drill 170 forward and backward, and for turning the drill 170 (i.e., by varying the speed and/or direction of the left and right tracks relative to each other). The tracks 172 support a platform 174 including a cab 176 and a mast 178. The platform 174 includes four jacks 180 that may be selectively raised and lowered via a hydraulic system. When lowered and set, the four jacks 180 prevent movement of the drill 170 for drilling. The mast 178 supports a drill bit 182 that is rotationally driven and selectively raised and lowered to bore into an area below the platform 174.

The drill 170 further includes an AC power supply (not shown) for driving various motors and components. The AC power supply may be transformed, rectified, inverted, filtered, and otherwise conditioned to power various AC and DC motors and components of the drill 170. For instance, the drill 170 may use the AC power supply to drive motors for propelling the drill 170 via tracks 172, and for rotationally driving the drill bit 182. Furthermore, the AC power supply, post-conditioning, may drive a DC electric motor to raise and lower the drill bit 182, for instance, using a chainless rack and pinion configuration. Additionally, the drill 170 includes an internal combustion engine, such as a diesel engine, to drive hydraulic pumps for various hydraulic systems of the drill 170. For instance, the hydraulic system may be used to selectively raise and lower the jacks 180 to properly level and stabilize the drill 170 before drilling. Additionally, the hydraulic system may be used to adjust the angle of the mast 178 to provide straight or angled drilling.

Figure 2:
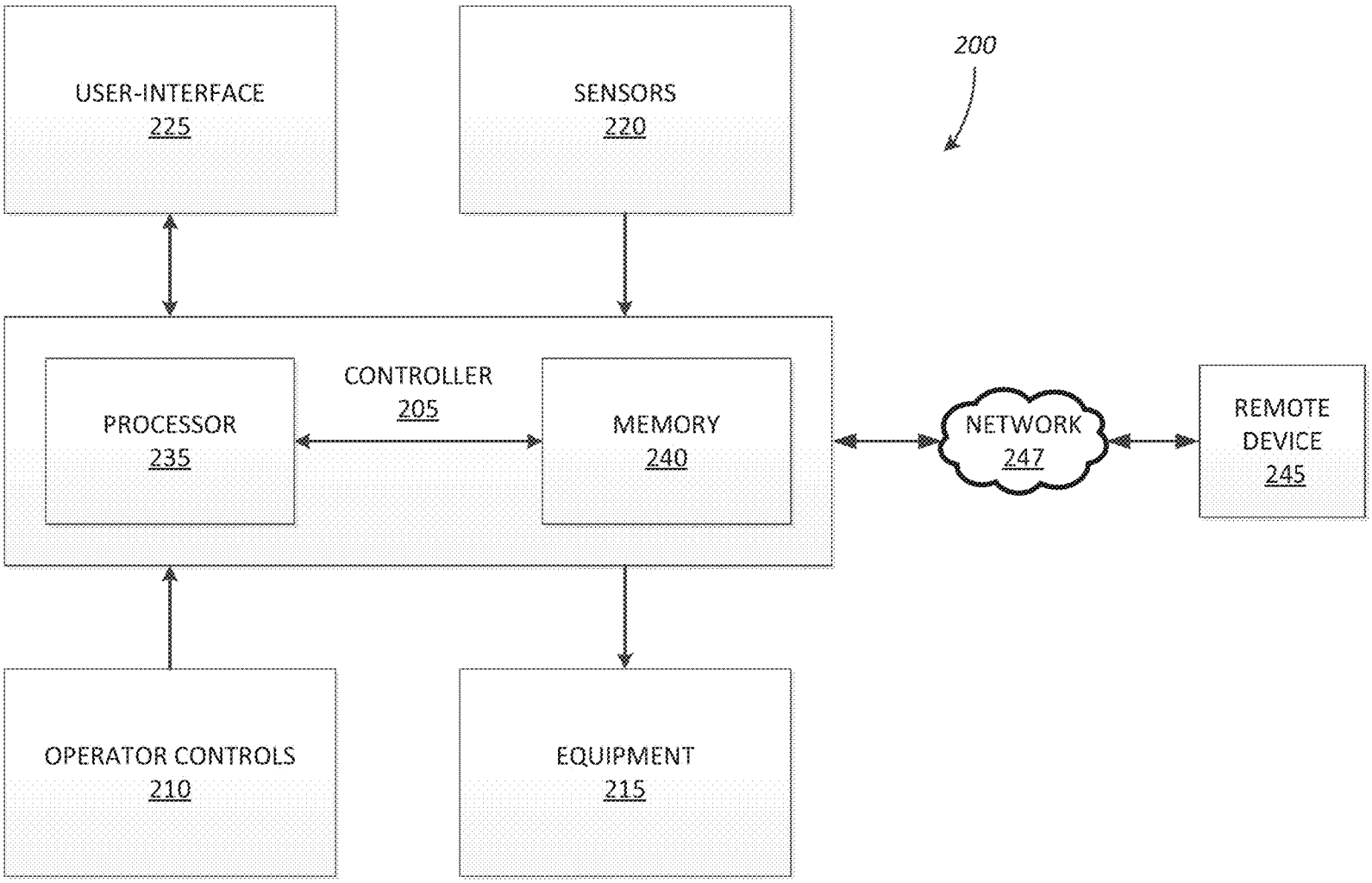
FIG. 2 illustrates a block diagram of a control system for the mining machines of FIGS. 1A and B.

FIG. 2 illustrates a control system 200 for use in mining machines, such as the shovel 100, the drill 170, or another device. For instance, in some embodiments, the control system 200 is part of a mobile mining crusher, a hybrid (diesel-electric) rope shovel, a conveyor unit, a dragline, a wheel loader and dozer, continuous miner, longwall shearer, longwall mining roof support, shuttle car, flexible conveyor train, mobile mining crusher or another mining machine.

The control system 200 includes a controller 205, operator controls 210, equipment controls 215, sensors 220, and a user-interface 225. The controller 205 includes a processor 235 and memory 240. The memory 240 stores instructions executable by the processor 235 and various inputs/outputs for, e.g., allowing communication between the controller 205 and the operator or between the controller 205 and sensors 220. In some instances, the controller 205 includes one or more of a microprocessor, digital signal processor (DSP), field programmable gate array (FPGA), application specific integrated circuit (ASIC), or the like.

The controller 205 receives input from the operator controls 210. For instance, in the shovel 100, the operator controls 210 include a crowd control, a swing control, a hoist control, and a door control. The crowd control, swing control, hoist control, and door control include, for instance, operator controlled input devices such as joysticks, levers, foot pedals, and other actuators. The operator controls 210 receive operator input via the input devices and output motion commands, such as analog or digital signals, to the controller 205. The motion commands include, for example, hoist up, hoist down, crowd extend, crowd retract, swing clockwise, swing counterclockwise, dipper door release, left track forward, left track reverse, right track forward, and right track reverse.

In the drill 170, the operator controls 210 include a drill feed control, drill torque/rotation speed control, mast angle control, tracks control, and jack(s) control, which may be, for instance, operator controlled input devices such as joysticks, levers, foot pedals, and other actuators. The operator controls 210 receive operator input via the input devices and output motion commands, such as analog or digital signals, to the controller 205. For the drill 170, the motion commands include, for example, drill feed up, drill feed down, drill rotation speed increase, drill rotation speed decrease, jack(s) up, jack(s) down, mast up, mast down, left track forward, left track reverse, right track forward, and right track reverse.

The above-described operator controls are exemplary. Other operator controls may be conveyed to the shovel 100, the drill 170, and other mining machines as well.

Upon receiving a motion command, the controller 205 generally controls the equipment 215 as commanded by the operator. In the shovel 100, the equipment 215 includes one or more crowd motors, swing motors, hoist motors, door latch motors, and track motors. For instance, if the operator indicates via swing control to rotate the handle 135 counterclockwise, the controller 305 will generally control the swing motor to rotate the handle 135 counterclockwise.

In the drill 170, the equipment 215 includes one or more drill rotational motors, drill feed motors, jack hydraulics, mast angle motors, and tracks motors. For instance, if the operator indicates via drill feed control to lower the drill bit 182, the controller 205 will generally lower the drill bit 182, absent, for example, an overriding safety mechanism.

The controller 205 is also in communication with a number of sensors 220 to monitor the location, movement, and status of the equipment 215. For example, for the shovel 100, the controller 205 is in communication with one or more crowd sensors, one or more swing sensors, one or more hoist sensors, and one or more door latch sensors. The crowd sensors indicate to the controller 205 the level of extension or retraction of the dipper 140. The swing sensors indicate to the controller 205 the swing angle of the handle 135. The hoist sensors indicate to the controller 205 the height of the dipper 140 based on the hoist cable 155 position. The door latch sensors indicate whether the dipper door 145 is open or closed. The door latch sensors may also include weight sensors, acceleration sensors, and inclination sensors to provide additional information to the controller 205 about the load contained within the dipper 145.

For the drill 170, the controller 205 is in communication with one or more drill rotational sensors, one or more drill feed sensors, one or more jack sensors, and one or more mast sensors. The drill rotational sensors indicate to the controller 205 the speed, torque, and acceleration of the drill bit 182. The drill feed sensors indicate to the controller 205 the position and movement of the drill feed. The jack sensors indicate the positions of the jacks (e.g., height) and movement of the jacks 180. The mast sensors indicate the position (e.g., angle) and movement of the mast 178.

The user-interface 225 provides information to the operator about the status of the mining machines, such as the shovel 100 or drill 170, and other systems communicating with the mining machines. The user-interface 225 includes one or more of the following: a display (e.g. a liquid crystal display (LCD)); one or more light emitting diodes (LEDs) or other illumination devices; a heads-up display (e.g., projected on a window of the cab 115); speakers for audible feedback (e.g., beeps, spoken messages, etc.); tactile feedback devices such as vibration devices that cause vibration of the operator's seat or operator controls 210; or another feedback device. The user-interface 225 and operator controls 210 may be positioned within a cab of the mining machine, such as the cab 115 or cab 176.

The controller 205 may also communicate with a remote device 245 via a network 247. The network 247 may include one or more servers, local area networks (LANs), wide area networks (WANs), the Internet, wireless connections, wired connections, etc. In some instances, the network 247 represents a direct, ad-hoc wireless connection between the controller 205 and the remote device 245. The remote device 245 may be, for instance, a server, a smart phone, a laptop, a personal computer, a tablet computer, etc. In the case where the remote device 245 is a server, the server may be accessible by one or more client devices (not shown), such as a smart phone, a laptop, a personal computer, a tablet computer, etc. The remote device 245 may include a processing device and a memory device, which may include a database storing mining data provided by the control system 200.

One or more state machines are defined for the mining machines, such as the shovel 100 and drill 170. The state machines define a plurality of states in which the mining machines may be. Each state definition includes an enter portion, an in-state portion, and an exit portion. The enter portion for a particular state defines the values of flags and conditions (collectively, parameters) that cause the mining machine to enter the state. The exit portion for a particular state defines the values of parameters that cause the mining machine to exit the state. The in-state portion defines parameters and/or actions of the mining machine while in a particular state.

Figure 3:
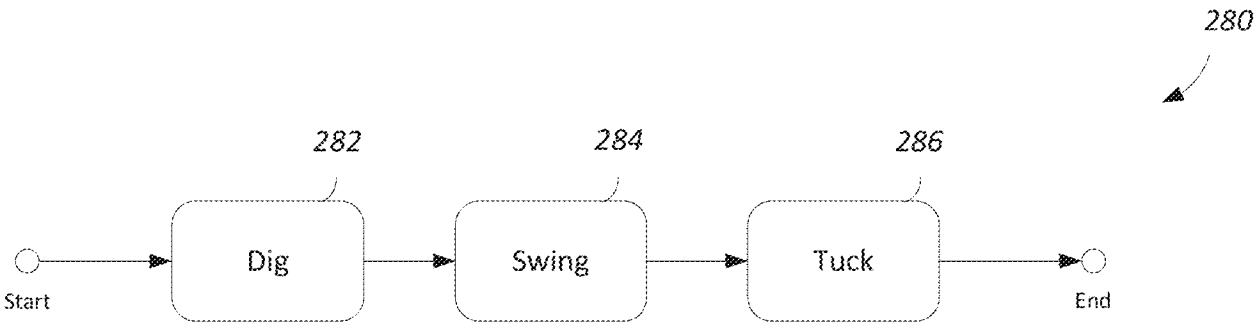
FIG. 3 illustrates a digging state machine for a mining shovel.

For example, FIG. 3 illustrates a digging state machine 280 for the shovel 100. The digging state machine 280 includes a dig state 282, a swing state 284, and a tuck state 286. In the dig state 282, the shovel 100 digs earthen material at a dig site with the dipper 140. In the swing state 284, the shovel 100 swings the dipper 140 from the dig site to a dump site (e.g., a hopper or dump truck). At the end of the swing state 284, the dipper door 145 is opened to dump the load. In the tuck state 286, the shovel 100 swings back towards the dig site while retracting the dipper 140, allowing gravity to shut the door 145 of the dipper 140 in preparation for another dig state.

Figure 4:
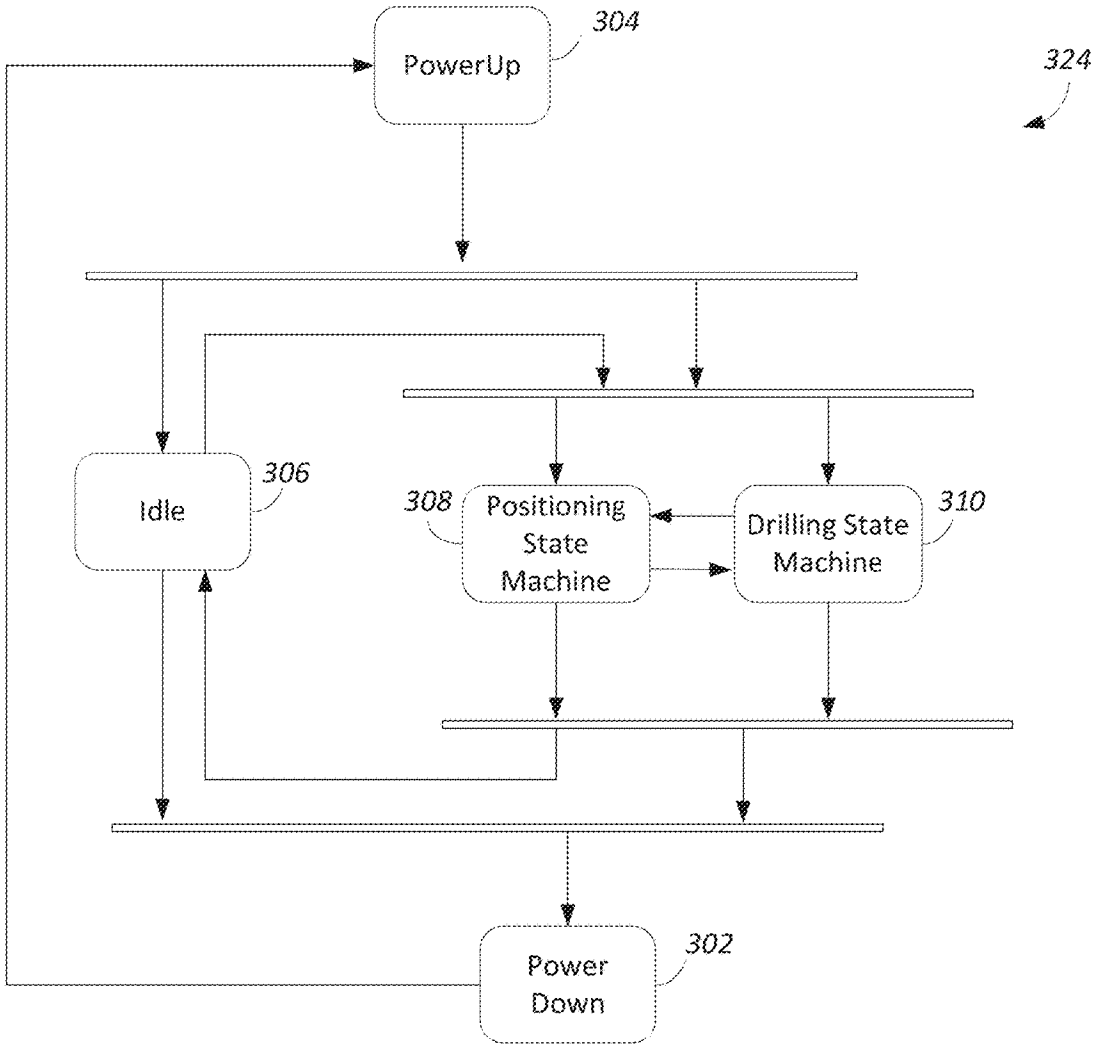
FIG. 4 illustrates a general state machine for a mining drill.

FIG. 4 illustrates a general state machine 300 for the drill 170. The drill 170 begins in a power-down state 302. Once powered, the drill 170 enters a power-up state 304. From the power-up state 304, the drill 170 may enter an idle state 306 when the drill is not moving or actively being operated. If the drill 170 is being operated, the drill 170 enters into one of the positioning state machine 308 and the drilling state machine 310.

Figure 5A:
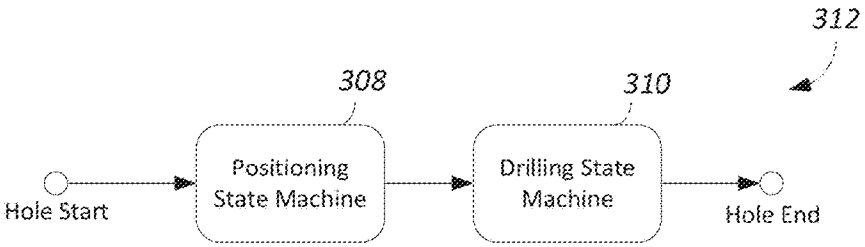
FIGS. 5A-C illustrate typical cycles for a mining drill.
Figure 5B:
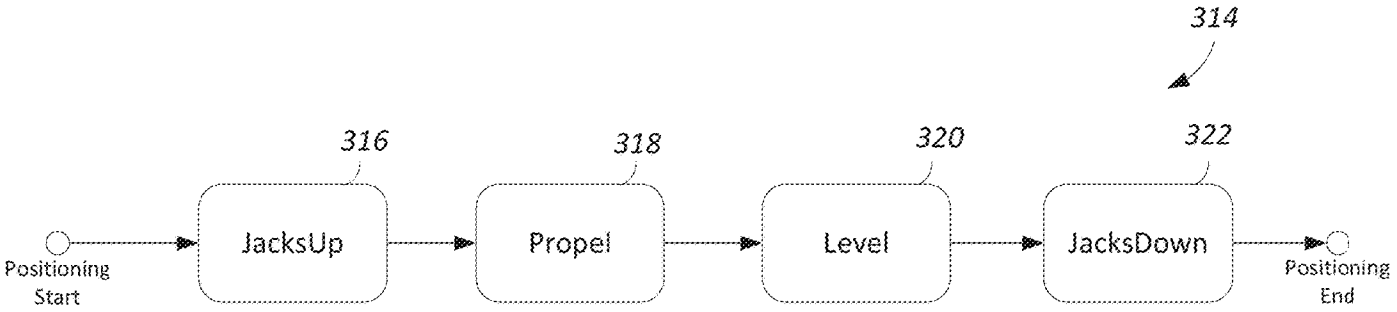
Figure 5C:
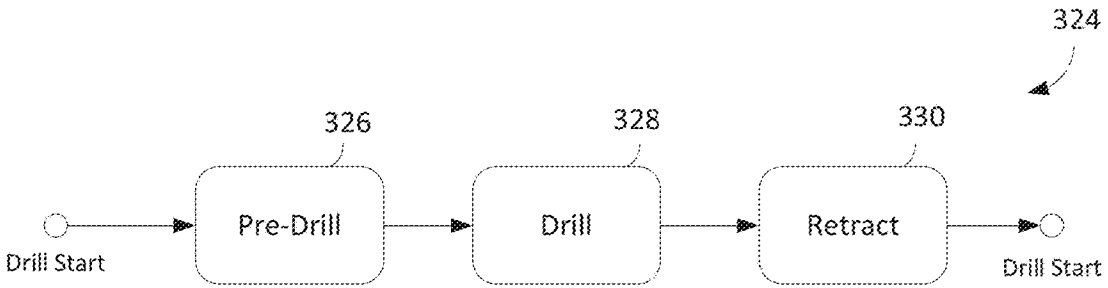

FIG. 5A-C illustrate typical cycles for the drill 170. FIG. 5A illustrates a typical drill cycle 312, which is marked by a start point (hole start) and an end point (hole end). To start the typical drill cycle, the drill 170 enters the positioning state machine 308 in which the drill 170 is moved into a position for drilling. Once positioning is complete, the drill 170 transitions to the drilling state machine 310 to drill a hole.

In the typical drill cycle 312, the drill 170 may proceed through the cycles of FIGS. 5B and 5C. FIG. 5B illustrates a typical positioning cycle 314, which would occur within the positioning state machine 308. Initially, the drill 170 retracts the jacks 180 in the jacks-up state 316. After the jacks 180 are retracted, the drill 170 proceeds to a propel state 318 where the drill 170 is moved via tracks 172 to the next drilling location. The drill 170 then enters a level state 320 to level the drill 170 in preparation for drilling. Once leveled, the drill 170 extends the jacks 180 in a jacks-down state 322.

FIG. 5C illustrates a typical drilling cycle 324, which would occur within the drilling state machine 310. Initially, the drill 170 enters a pre-drill state 326 to pre-drill a hole. Thereafter, the drill 170 enters a drill state 328 and drills the hole. Subsequently, the drill 170 retracts the drill bit 182 from the hole in the retract state 330.

Figure 6A:
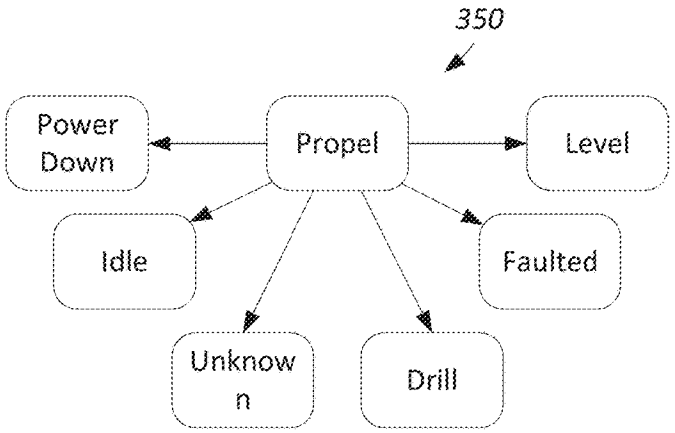
FIGS. 6A-B illustrate exemplary transition maps for a mining drill state machine.
Figure 6B:
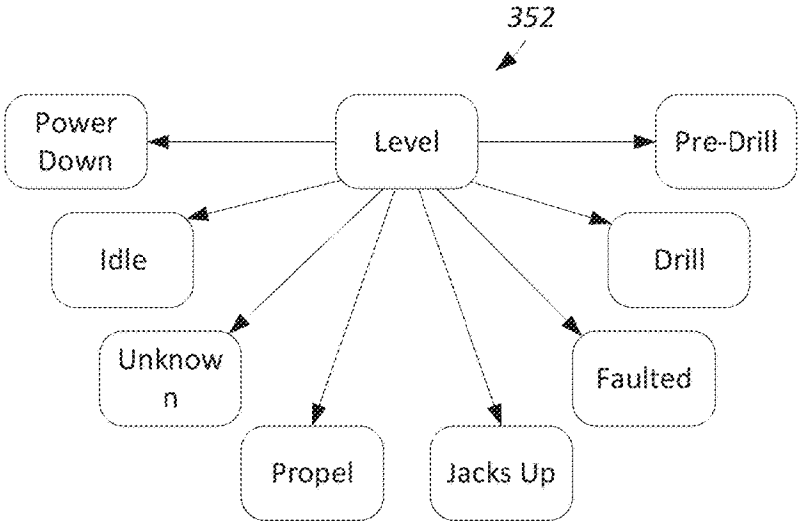

Each machine state has a defined set of states to which the machine may be transitioned. The defined set of states may be illustrated in a transition map for each state. Two such transition maps are illustrated in FIGS. 6A-B for the drill 170. Additionally, exemplary transition criteria for the illustrated transition maps are set forth in the below Tables II to III FIG. 6A illustrates a transition map 350 for the propel state. As shown in the transition map 350, the state machine may transition from the propel state to one of the power-down, idle, unknown, drill, faulted, and level states according to the criteria in Table II below.

TABLE II

| Transitions from Propel State | |
|---|---|
| Transition Path | Conditions to Meet |
| To Level | One/All Jacks down |
| To Faulted | Any Faults causing shut down |
| To Drill | Machine Level |
| To Unknown | Power not down |
| To Idle | Power Not Down<br>Propelling is False<br>No Jacks Down |
| To PowerDown | Power Down |

FIG. 6B illustrates a transition map 352 for the level state. As shown in the transition map 352, the state machine may transition from the level state to one of the power-down, idle, unknown, propel, jacks-up, drill, and pre-drill states according to the criteria in Table III below.

TABLE III

| Transitions from Level State | |
|---|---|
| Transition Path | Conditions to Meet |
| To Pre-Drill/ Collaring | Machine Level Flag is True<br>Rotary RPM is > 0<br>Feed Rate at appropriate value<br>'Reset Depth Counter' is reset.<br>Carriage brake released |
| To Drill | Rotary RPM > 0<br>Carriage brake released |
| To Faulted | Any faults causing shutdown or stopping from leveling |
| To Propel | Propelling = True |
| To Unknown | No defined transition for x minutes |
| To JacksUp | At least one jack is retracted |
| To PowerDown | Power down = True |
| To Propel | Propelling = True |

Figure 7:
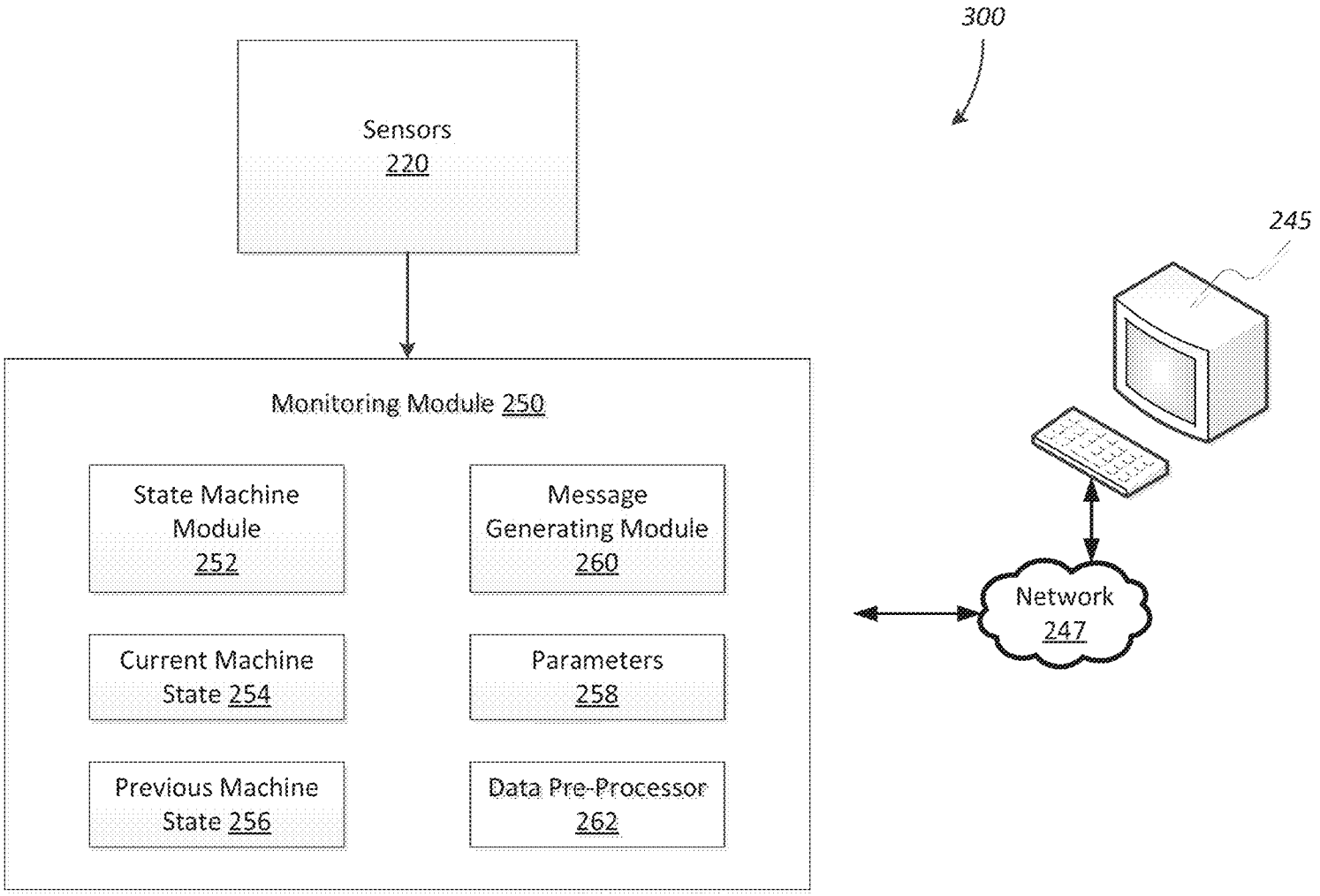
FIG. 7 illustrates a monitoring module for a mining machine.

FIG. 7 illustrates a monitoring module 250. The monitoring module 250 is implemented, for instance, by the processor 235 and memory 240 of the controller 205. In other embodiments, however, the monitoring module 250 is implemented by a processing device other than the controller 205 on the mining machine, external to the mining machine, or a combination thereof.

The monitoring module 250 includes a state machine module 252, a current machine state 254, a previous machine state 256, parameters 258, a message generating module 260, and a data pre-processor 262. The state machine module 252 determines and tracks the state of the mining machine based on parameters 258, the current machine state 254, and the previous machine state 256. The current machine state 254 indicates the current state of the mining machine. The previous machine state 256 indicates the previous state of the mining machine. The current machine state 256 and previous machine state 256 may be data stored in a memory, such as memory 240.

The parameters 258 include flags, sensor data obtained from sensors 220 (e.g., depth of drill, speed of tracks 105/172, revolutions per second of various motors, and torque values), and other parameters used by the state machine module 252. The parameters 258, also referred to as mining machine parameters, may be stored in a memory, such as the memory 240.

The state tracking of the state machine module 252 is based on detecting state transitions, rather than continuously detecting the present state. Accordingly, once in a particular state, the machine will stay in that state until the state machine module 252 determines that transition criteria, i.e., exit parameters and entrance parameters, are met. The new state that is entered is based on the enter parameters of the particular state being met. A transition between one state to another may reflect transitioning between states of two state machines, or between states of one state machine. For example, when transitioning between the propel state to the level state, the drill 170 remains in the positioning state machine 308. However, transitioning from the level state to the pre-drill state reflects a transition from the positioning state machine 308 to the drilling state machine 310.

The message generating module 260 generates simple events and associated messages for output to the remote device 245 via the network 247. The simple event and associated message may be referred to collectively as a simple event message or a contextual message. The message generating module 260 receives an indication from the state machine module 252 when the mining machine has entered or exited a state. In response, the message generating module 260 generates and outputs a simple event message. For example, a simple event message may be generated and output upon exiting a pre-drill state and upon entering a drill state. Thus, two simple event messages, an enter drill state message and an exit pre-drill state message, may be output from a single state transition. In some embodiments, rather than a separate enter and exit message, a single simple event message (a transition message) is generated that is particular to the transition that occurred, such as a pre-drill to drill state message.

Additionally, the message generating module 260 determines to generate a simple event message without prompting from the state machine 252. The message generating module 260 may monitor parameters 258 and, upon determining certain conditions are met, generate and output a simple event message. For example, the message generating module 260 may trigger based on reaching various progress thresholds during operation. For instance, while the drill 170 drills a hole in the drill state, the message generating module 260 will trigger a simple event on each foot of drilling, with each foot of hole-depth being a separate progress threshold. Accordingly, the message generating module 260 will generate and output a simple event message regarding the drill 170 and its current operation for each foot drilled. In other embodiments, different progress thresholds are used, such as six inches, five feet, or ten feet.

In some embodiments, the message generating module 260 uses time-based thresholds to generate simple event messages periodically while within a state. For instance, a simple event message may be generated while in a particular state every ten seconds, minute, five minutes, etc. The time between generating simple event messages may vary by state. For instance, a state that lasts several minutes may have a longer elapsed time between simple event messages than a state that lasts less than a minute.

Simple event messages generated by the message generating module 260 include an indication of the simple event (e.g., a simple event name), one or more of the current machine state 254, previous machine state 256, and all or a select portion of the parameters 258. In some instances, the simple event messages or portions thereof are displayed on the user-interface 225 instead of or in addition to providing the messages to the remote device 245.

A simple event message is used to notify maintenance staff of errors and warnings that generally do not require operator intervention. The information added via an associated message makes the simple event more valuable to maintenance staff and other machine operators. In addition, the simple event can be subscribed to using an OPC Alarm and Event server, which allows the events and associated messages to be received and processed by external systems (e.g., the remote device 245) and operators. In some embodiments, the simple events and/or the associated messages are structured as extensible markup language ("XML") data. XML is an open standard specification produced by the World Wide Web Consortium ("W3C") that is known for its structured data that can be used to store and transfer data. Therefore, additional information about the machine can be packaged as XML and passed as a message with a simple event.

The information provided with the simple event can be used by various production monitoring systems. For example, the parameters 258 may be packaged into an XML data structure provided with the simple event, which can then be used as desired by a original equipment manufacturer ("OEM") receiving the simple even message. For instance, the OEM may use some of the parameters 258 to calculate specific energy or efforts required to drill a portion of a hole (e.g., each foot of a hole). Additionally, various mines use various methods to calculate the specific energy and blasting index. By using the above described systems, third-party software can obtain the XML message provided by the message generating module 260 and can use all or a subset of the parameters 258 contained in the message to perform a calculation of energy or effort. In this regard, the standard information that is minimally required to perform such a calculation are included in the XML structure and the third-party software can use all or a subset of the information to perform a predetermined calculation.

For example, in some embodiments, the efforts required to drill each foot of a hole can be calculated using some of the parameters 258 such as rate of penetration ("ROP"), pull down pressure, torque, RPM, weight on bit, and bit air pressure. These parameters can be included in the message associated with a simple event.

As noted above, the simple event message can include structured XML, but the message may also include delimited text (e.g., text delimited by a semi-colon, comma, or another identifiable character). The third-party monitoring system can use the data included in the simple event message and customer- or location-specific information, such as the diameter of the hole being drilled, the diameter of the drill bit 182 being used, and soil information, to calculate a specific energy or effort required to drill a particular hole. The calculated energies or efforts can then be used to monitor the performance of the drill 170 and associated equipment. For example, the energy required for each drilled hole can be tracked over time to identify when a particular drill bit 182 should be replaced to maintain efficiency.

The simple event messages generated for the mining machines (e.g., the shovel 100 and dipper 170) are particular to the state of that mining machine. For example, a simple event message generated for the drill 170 while in the drill state is different than a simple event message generated for the drill 170 while in the propel state. More specifically, in a drill state, the simple event message includes a portion of the parameters 258 that are of more interest for review and analysis when the drill 170 is in the drill state. In the propel state, the simple event message includes a different portion of the parameters 258 that are of more interest for review and analysis when the drill 170 is in the propel state. Generation of the simple event message may include packaging an identification of the context of the mining machine (i.e., the state) and the pertinent portion of the parameters 258 in an XML format.

For example, on transition from the level state to the pre-drill state, the simple event message may include the hoist resolver reading (i.e., hoist position) and global positioning satellite (GPS) coordinates of the drill 170 or the bit 182. While pre-drilling, the simple event message may include the feedrate, RPM, and vibration of the bit 182. The simple event message may not leave out the GPS position because the absolute position of the drill 170 and bit 182 may be derived from a current hoist resolver reading and the previously-sent GPS coordinates and hoist resolver reading. Furthermore, on transition from the pre-drill state to the drill state, the simple event message may include the hoist resolver position, the time of day, and set points of the drill 170, if in autodrill mode, or the manual settings of the drill 170, if in manual drill mode.

With respect to the shovel 100, a simple event message upon completion of a dig state may include parameters 258 obtained during the dig cycle including payload data, start position of the crowd and hoist, end position of the crowd and hoist, max hoist height, max crowd extension, root-mean-square (RMS) load current supplied to the crowd and hoist motors. In contrast, a simple event message upon completion of the tuck state may include the distance and speed data from crowd, hoist, and swing motors, but not include payload data or RMS current load data. Since the dipper 140 should be empty in a tuck state, an OEM or third party analyzing obtained data from the shovel 100 may be less concerned with the payload and motor current during a tuck operation, but more concerned with the speed and efficiency of the operator's technique to return from a dump site to the next dig cycle. A simple event message upon completion of a swing state may include data indicating when braking started during the swing operation, the change in swing angle, the RMS current load of the swing motor, and the starting and ending position of the swing motor. Accordingly, the portion of the parameters 258 included in a simple event message is different depending on the context (i.e., state) of the mining machine.

Accordingly, rather than sending all of the parameters 258 each time a simple event occurs, a portion of the parameters 258 specific to the simple event are included in a simple event message. This technique reduces the amount of data communicated, reducing the data traffic on the network 247. Additionally, in instances where the remote device 245 includes a database storing the simple event messages, the amount of data that is stored in the database is reduced and the amount of data necessary to be read from the database for performing analysis may be reduced. Accordingly, the complexity and size of the database may be reduced, while the speed of database communications (reads/writes) is increased.

A simple event message may include one or more of a simple event name, a type portion to indicate that the message is of the simple event type, a text message portion, an XML portion, and a string delimiter portion. Described below are three example simple event messages: a hole start message, a hole state message, and a hole end message.

The hole start message occurs when the drill 170 enters the drill state, at which point the depth counter should be reset and the rotary speed of the drill bit 182 should be greater than zero. An example hole start message is provided below in Table IV. The holeID parameter identifies the hole being drilled; the GPS Location parameter identifies the GPS Location of the hole; the operatorID parameter indicates the operator of the drill 170; and the shiftID parameter indicates current employee working shift (e.g., first shift, second shift, or third shift) at the time of the simple event.

TABLE IV

| Example Hole Start Message | |
|---|---|
| Simple Event Name | 33-HoleStart |
| Type | Simple Event |
| Message | The HoleID is 11001. The GPS Location is −1.23,83.24. The OperatorID is 16011. The ShiftID is 1. |
| XML: | <HoleIE>11001</HoleID><GPS> −1.23,83.24</GPS><OpID>16011</OpID> <ShiftID>1</ShiftID> |
| StringDelimiter | 11001; −1.23,83.24; 16011; 1 |

The hole state message is sent for every foot of drilling and occurs in the drill state. An example hole state message is provided below in Table V. The F parameter indicates the depth of the hole in feet (ft), PD parameter indicates the pull down force in kilo-pounds (klbs); RS parameter indicates the rotary speed of the bit 182 in rotations per minute (RPM); the TQ parameter indicates the rotary torque of the bit 182 in foot-pounds (ft-lbs); the ROP parameter indicates the rate of penetration of the bit 182; the AD parameter is a binary flag that indicates whether the drill 170 is operating in an auto drill mode or manual drill mode; and the EX parameter is a binary flag that indicates whether an exception occurred, such as a excessive vibration exception. In some instances, additional parameters are included in the hole state message, such as a weight-on-bit parameter, bit air pressure parameter (pounds per square inch (PSI)), feed rate parameter (feet per minute), horizontal vibration parameter (RMS value), and vertical vibration parameter (RMS value).

TABLE V

| Example Hole State Message | |
|---|---|
| Simple Event Name | 33-HoleState |
| Type | Simple Event |
| Message | The hole is 1 foot deep; the pull down force is 10001; the rotational speed is 1234 RPM; the torque is 101; the rate of penetration is 12; the drill is in AutoDrill mode; the AAD is 0; the exception flag is not set. |
| XML: | <F>1</F><PD>100001</PD> <RS>1234</RS><TQ>101</TQ><ROP>12</ROP> <AD>l</AD><AAD>0</AAD><EX>0</EX> |
| StringDelimiter | 1; 100001; 1234; 101; 12; 1; 0; 0 |

The hole end message occurs when the drill 170 exits the drill state, at which point the bit 182 should be fully retracted, the jacks 180 should be up. Cleanup drilling should generally also be complete before the hole end message is sent. An example hole start message is provided below in Table VI, which includes the same parameters as the hole start message.

TABLE VI

| Example Hole End Message | |
|---|---|
| Simple Event Name | 33-HoleEnd |
| Type | Simple Event |
| Message | The HoleID is 11001. The GPS Location is −1.23,83.24. The OperatorID is 16011. The ShiftID is 1. |

TABLE VI-continued

| Example Hole End Message | |
|---|---|
| XML | <HoleIE>11001</HoleID><GPS> −1.23,83.24</GPS><OpID>16011</OpID> <ShiftID>1</ShiftID> |
| StringDelimiter | 11001; −1.23,83.24; 16011;1 |

Although the above hole start, hole state, and hole end messages are shown as including a text portion, an XML portion, and a stringdelimiter portion, such messages may include only one or two of the text portion, XML, portion, and stringdelimiter portion.

Table VII below lists exemplary selections of the parameters 258 provided in simple event messages for the shovel 100 during various states. For example, a simple event message sent while within the tuck state includes RMS hoist armature current, Fourier transform and torque hoist field current, RMS crowd armature current, etc., but not hoist armature voltage data, hoist interpole temperature data, etc. In contrast, a simple event message sent while within the dig state includes RMS, maximum, and minimum hoist armature current; RMS, standard deviation, maximum, and minimum hoist armature voltage; etc., but not swing armature current, swing speed, etc. The particular parameters 258 sent for particular states as listed below are exemplary, and, in other embodiments, different parameters 258 are selected to be sent and not selected to be sent.

TABLE VII

Select Parameters for Simple Event Messages of Shovel 100

| Motion | Sensors | Parameters for Tuck State Context Message | Parameters for Dig State Context Message | Parameters for Swing State Context Message |
|---|---|---|---|---|
| Hoist | Armature Current | RMS | RMS, Max Min | RMS, Max Min |
| | Armature Voltage | | RMS, StdeV, Max, Min | |
| | Field Current | FFT & Torque | FFT & Torque | FFT & Torque |
| | Speed | Integral, Average | Integral, Max, Min Mean | |
| | Position | Start, End, Distance(Path) | Start, End, Distance(Path) | Start, End, Distance(Path) |
| | Interpole Temp | | Avg, Max, Min, Mean | |
| | Field Temp | | Avg, Max, Min, Mean | |
| | Operator Ref | | | |
| Crowd | Armature Current | RMS | RMS, Max Min | RMS, Max Min |
| | Armature Voltage | | RMS, StdeV, Max, Min | |
| | Field Current | FFT & Torque | FFT & Torque | FFT & Torque |
| | Speed | Integral, Average | Integral, Max, Min Mean | |
| | Position | Start, End, Distance(Path) | Start, End, Distance(Path) | Start, End, Distance(Path) |
| | Interpole Temp | | Avg, Max, Min, Mean | |
| | Field Temp | | Avg, Max, Min, Mean | |
| | Operator Ref | | | |

TABLE VII-continued

Select Parameters for Simple Event Messages of Shovel 100

| Motion | Sensors | Parameters for Tuck State Context Message | Parameters for Dig State Context Message | Parameters for Swing State Context Message |
|---|---|---|---|---|
| Swing | Armature Current | RMS, Max Min | | RMS, Max Min |
| | Armature Voltage | RMS, StdeV, Max, Min | | RMS, StdeV, Max, Min |
| | Field Current | FFT & Torque | | FFT & Torque |
| | Speed | Integral, Max, Min Mean | | Integral, Max, Min Mean |
| | Position | Start, End, Distance(Path) | Start, End, Distance(Path) | Start, End, Distance(Path) |
| | Interpole Temp | Avg, Max, Min, Mean | | Avg, Max, Min, Mean |
| | Field Temp | Avg, Max, Min, Mean | | Avg, Max, Min, Mean |
| | Operator Ref | | | |

The exemplary selections of the parameters 258 listed above may be sent upon entrance to a particular state, exit from the particular state, and while within the particular state. For instance, when entering the swing state, the parameters 258 listed in the right column for each of the hoist motion, crowd motion, and swing motion may be included in a simple event message. Additionally, when exiting the swing state, the same parameters 258 may be included in a simple event message. Furthermore, once (half-way through) or periodically (e.g., every ten seconds) within the swing state, a simple event message with the same parameters 258 may be generated and sent.

In some instances, the parameters 258 included in a simple event message vary depending on whether the machine is entering a state, exiting the state, or present (remaining) in the state. For example, in some embodiments, upon entry into the tuck state, a generated simple event message includes the swing position, the crowd position, the hoist position, and the current time of day; upon exit into the tuck state, the same data is included in a generated simple event message; and while in the tuck state, the parameters 258 listed above in Table VII for the tuck state are included in a generated simple event message.

Figure 8:
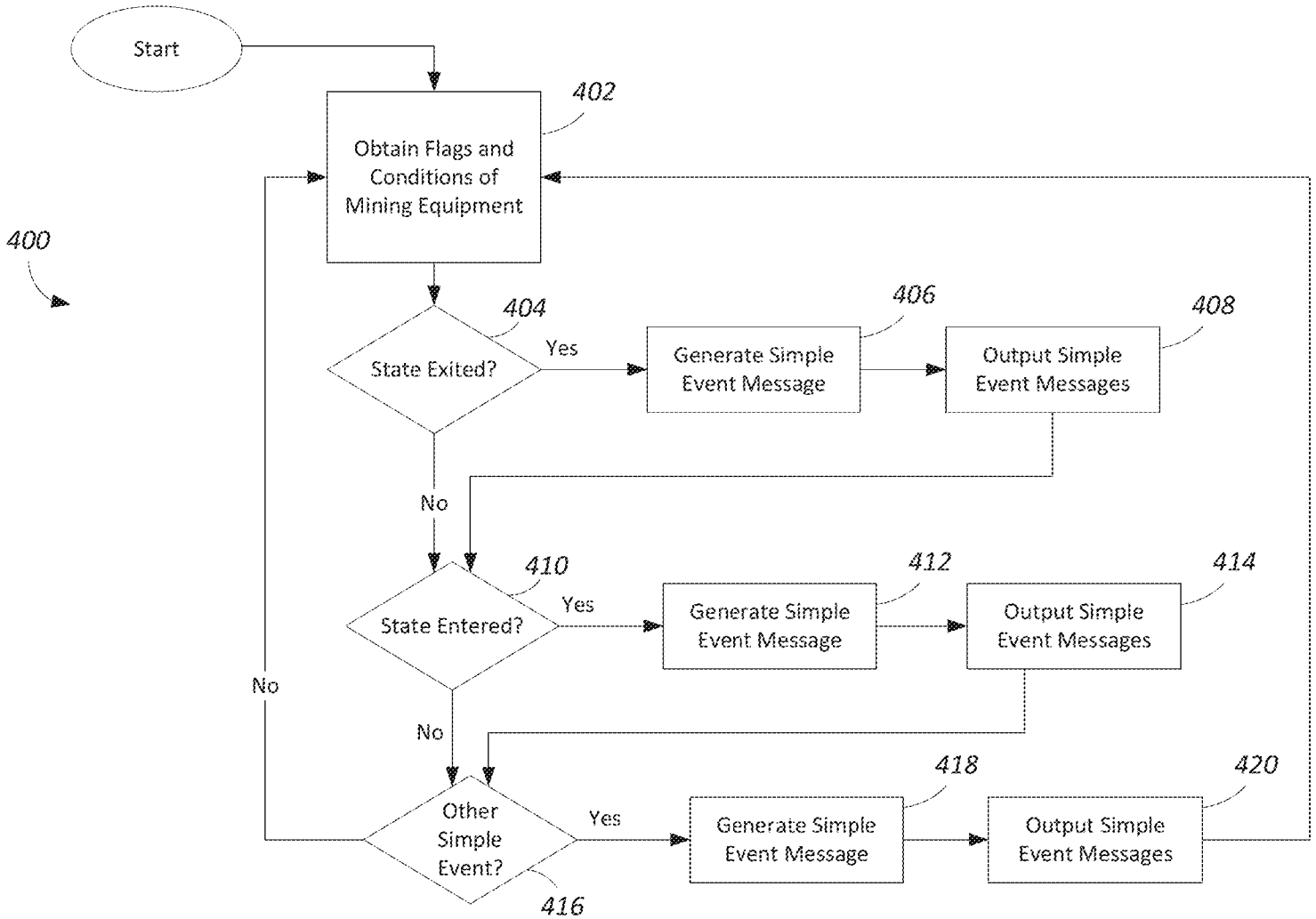
FIG. 8 illustrates a method of generating simple event messages for a mining machine.

FIG. 8 illustrates a method 400 for generating simple event messages using the monitoring module 250. In step 402, the message generating module 260 and the state machine module obtain the parameters 258. In step 404, the state machine module 252 determines whether the mining machine (e.g., the drill 170 or shovel 100) has exited a state. If so, the state machine module 252 indicates the state transition to the message generating module 260. In response, in step 406, the message generating module 260 generates a simple event message (a "state exit message") including a portion of the parameters 258 particular to the exited state. In step 408, the message generating module 260 outputs the generated simple event message to the remote device 245, the user interface 225, or both.

The monitoring module 250 proceeds to step 410, where the state machine module 252 determines whether a new state has been entered. If so, the state machine module 252 indicates the state transition to the message generating module 260. In response, in step 412, the message generating module 260 generates a simple event message (a "state start message") including a different portion of the parameters 258 particular to the entered state. In step 408, the message generating module 260 outputs the generated simple event message to the remote device 245, the user interface 225, or both.

In step 416, the message generating module 260 determines whether the parameters 258 and current state machine 254 satisfy trigger conditions of a simple event. For instance, the message generating module 260 may determine that the drill 170 is in the drill state and that a progress threshold has been satisfied, such as another foot of drilling being completed. If so, the message generating module 260 generates a simple event message including a different portion of the parameters 258 particular to the simple event (step 418). In step 420, the message generating module 260 then outputs the generated simple event message to the remote device 245, the user interface 225, or both. In some instances, the message generating module 260 may determine in step 416 that a predetermined time has elapsed while within a state, or has elapsed since the last simple event message has been generated, and determine to proceed to steps 418 and 420 to generate and send a simple event message.

Returning to FIG. 7, the data pre-processor 262 tracks mining machine data over time, processes the data, and generates processed-data messages. Thus, the processed-data message includes calculations related to data collected over time. For instance, the processed-data message may include maximum, minimum, and average values collected over a predetermined period (e.g., ten dig cycles of the shovel 100, twelve hours, one month, etc.). The processing may also include root mean squared (RMS) calculations, Fourier transforms, and other data processing. To generate the processed-data message, the data pre-processor 262 may periodically obtain particular parameters of the parameters 258 for temporary storage. Then, at the end of a predetermined period, the data pre-processor 262 performs calculations on the temporarily stored parameters. For example, the data pre-processor 262 may obtain an air temperature near the shovel 170 each hour of a day from the parameters 258. At the end of the day, the data pre-processor 262 may calculate the average, maximum, and minimum temperature for that day based on the obtained temperature data. Thereafter, the data pre-processor 262 may generate and output a processed-data message including the average, maximum, and minimum temperature. The generated processed-data message may then be sent to the user interface 225, the remote device 245, or both.

Hourly, daily, monthly, and annually generated processed-data messages may include calculations data related to calculations of averages, maximums, minimums, root-mean-squared (RMS) values, standard deviation values, etc., for temperature, payload, current drawn by a motor (e.g., hoist, crowd, swing motors), vibration data, overall power consumption by the mining machine, and other data types.

A processed-data message may be sent alone or the data of a processed-data message may be incorporated into a simple event message similar to how other data (e.g., parameters 258) is sent upon the occurrence of a simple event. For example, as indicated in Table VII above, processed data, such as RMS data, may be included in simple event messages.

Accordingly, rather than sending essentially raw data continuously or in relatively quick increments (e.g., 10 minute intervals), data is collected and analyzed locally by the monitoring module 250 and resulting calculations data is sent periodically. This technique reduces the amount of data communicated, reducing the data traffic on the network 247, which improves scalability of the system for use with many mining machines. For instance, the number of reads and writes to a database of the remote server 245 that would otherwise store the raw data to-be-analyzed is drastically reduced because each individual mining machine performs a portion of the analysis. In some embodiments, the raw data is still sent to the remote device 245 for backup storage and to allow an OEM to further analyze the data as necessary.

Accordingly, embodiments of the invention provide an event-based monitoring system that packages monitored information regarding drilling equipment as XML data, which can be used by third-party monitoring systems to determine machinery states, cycles, and other productivity-related statistics.

What is claimed is:

1. A method of monitoring a mining drill, the method comprising:

monitoring mining machine parameters of the mining drill;

determining, with a processor of the mining drill, a current operational state for the mining drill;

selecting, with the processor of the mining drill, a first set of parameter types based on the current operational state;

generating, with the processor of the mining drill, a state message indicating the current operational state of the mining drill and a parameter value for each parameter type of the first set of parameter types; and transmitting, with the processor of the mining drill, the state message from the mining drill to a device for display to a user;

when the current operational state of the mining drill is a drill state:

determining, with the processor of the mining drill, when the mining drill reaches a plurality of progress thresholds while drilling a hole, each progress threshold representing a depth of the hole, and each time the mining drill is determined to reach one of the progress thresholds:

selecting, with the processor of the mining drill, a second set of parameter types based on the drill state of the mining drill, wherein the second set of parameter types and the first set of parameter types are different, generating, with the processor of the mining drill, a drill context message including an indication of the drill state of the mining drill and a parameter value for each parameter type of the second set of parameter types, and transmitting, with the processor of the mining drill, the drill context message from the mining drill to the device for display to the user.

2. The method of claim 1, wherein the drill context message includes the parameter value for each parameter type of the second set of parameter types structured as one of markup language data and string data.

3. The method of claim 1, wherein the second set of parameter types includes at least one selected from a group consisting of the depth of the hole, pull down force, rotational speed of a drill bit of the mining drill, torque of the drill bit, rate of penetration of the drill bit, weight on the drill bit, air pressure of the drill bit, feed rate, horizontal vibration, and vertical vibration.

4. The method of claim 1, wherein determining the current operational state of the mining drill includes determining that the mining drill has completed drilling the hole and wherein generating the state message includes generating a hole end message indicating that the hole has been drilled.

5. The method of claim 1, wherein determining the current operational state of the mining drill includes determining that the mining drill is operating in a new operation state and wherein generating the state message includes generating a state start message indicating a start of the new operation state.

6. The method of claim 1, further comprising:

performing calculations, with a pre-processor on the mining drill, on a series of data values collected over a period of time for each parameter type of the first set of parameter types, the calculations generating calculated data;

generating a processed-data message including the calculated data; and outputting the processed-data message to the device via a network, wherein the device is a remote device.

7. The method of claim 6, wherein the calculations include at least one of an average computation, maximum determination, minimum determination, root mean squared (rms) calculation, and a fourier transform.

8. A mining machine monitor for monitoring a mining drill, the mining machine monitor comprising:

a monitoring module that monitors mining machine parameters of the mining drill;

a state machine module that determines that a current operational state for the mining drill; and a message generating module, implemented by a processor of the mining drill, that monitors progress of the mining drill in drilling a hole, selects a first set of parameter types based on the current operational state, generates a state message indicating the current operational state of the mining drill and a parameter value for each parameter type of the first set of parameter types, and transmits the state message from the mining drill to a device for display to a user, when the current operational state of the mining drill is a drill state:

determines when the mining drill reaches a plurality of progress thresholds while drilling the hole, each progress threshold representing a depth of the hole, and each time the mining drill is determined to reach one of the progress thresholds:

selects, with the processor of the mining drill, a second set of parameter types based on the drill state of the mining drill, wherein the second set of parameter types and the first set of parameter types are different, generates, with the processor of the mining drill, a drill context message including an indication of the drill state of the mining drill and a parameter value for each parameter type of the second set of parameter types, and transmits, with the processor of the mining drill, the drill context message from the mining drill to a device for display to a user.

9. The mining machine monitor of claim 8, wherein the drill context message includes the parameter value for each parameter type of the second set of parameter types structured as one of markup language data and string data.

10. The mining machine monitor of claim 8, wherein the second set of parameter types includes at least one selected from a group consisting of the depth of the hole, pull down force, rotational speed of a drill bit of the mining drill, torque of the drill bit, rate of penetration of the drill bit, weight on the drill bit, air pressure of the drill bit, feed rate, horizontal vibration, and vertical vibration.

11. The mining machine monitor of claim 8, wherein the state machine module determines the current operational state of the mining drill by determining that the mining drill has completed drilling the hole; and the message generating module generates the state message by generating a hole end message indicating that the hole has been drilled.

12. The mining machine monitor of claim 8, wherein the state machine module determines the current operational state of the mining drill by determining that the mining drill is operating in a new operation state; and the message generating module generates the state message by generating a state start message indicating a start of the new operation state.

13. The mining machine monitor of claim 8, further comprising a pre-processor on the mining machine, the pre-processor performing calculations on a series of data values collected over a period of time for each parameter type of the first set of parameter types, the calculations generating calculated data;

generating a processed-data message including the calculated data; and outputting the processed-data message to the device via a network, wherein the device is a remote device.

14. The mining machine monitor of claim 13, wherein the calculations include at least one of an average computation, maximum determination, minimum determination, root mean squared (rms) calculation, and a fourier transform.

15. A mining machine monitor for monitoring a mining drill, the mining machine monitor comprising:

a memory storing instructions; and a processor of the mining drill, the processor coupled to the memory and configured to execute the instructions to perform a set of functions, the set of functions including:

monitoring mining machine parameters of a mining drill;

determining a current operational state for the mining drill;

selecting a first set of parameter types based on the current operational state;

generating a state message indicating the current operational state of the mining drill and a parameter value for each parameter type of the first set of parameter types; and transmitting the state message from the mining drill to a device for display to a user;

when the current operational state of the mining drill is a drill state:

monitoring progress of the mining drill in drilling the hole, determining when the mining drill reaches a plurality of progress thresholds while drilling a hole, each progress threshold representing a depth of the hole, and each time the mining drill is determined to reach one of the progress thresholds:

selecting a second set of parameter types based on the drill state of the mining drill, wherein the second set of parameter types and the first set of parameter types are different, generating a drill context message including an indication of the drill state of the mining drill and a parameter value for each parameter type of the second set of parameter types, and transmitting the drill context message from the mining drill to a device for display to a user.

16. The mining machine monitor of claim 15, wherein the memory is part of the mining drill.

17. The mining machine monitor of claim 15, wherein the second set of parameter types includes at least one selected from a group consisting of the depth of the hole, pull down force, rotational speed of a drill bit of the mining drill, torque of the drill bit, rate of penetration of the drill bit, weight on the drill bit, air pressure of the drill bit, feed rate, horizontal vibration, and vertical vibration.

18. The mining machine monitor of claim 15, wherein determining the current operational state of the mining drill includes determining that the mining drill has completed drilling the hole and wherein generating the state message includes generating a hole end message indicating that the hole has been drilled.

19. The mining machine monitor of claim 15, wherein determining the current operational state of the mining drill includes determining that the mining drill is operating in a new operation state and wherein generating the state message includes generating a state start message indicating a start of the new operation state, wherein the state start message includes a third set of parameter types associated with the new operation state.

20. The mining machine monitor of claim 15, wherein the set of functions further includes performing calculations on a series of data values collected over a period of time for each parameter type of the first set of parameter types, the calculations generating calculated data, generating a processed-data message including the calculated data, and outputting the processed-data message to the device via a network, wherein the device is a remote device.

* * * * *